United States Patent [19]

Washino et al.

[11] 4,246,511

[45] Jan. 20, 1981

[54] ELECTRON GUN

[75] Inventors: Shoichi Washino, Amagasaki; Eisho Nosaka, Nagaokakyo, both of Japan

[73] Assignee: Mitsubishi Denki Kabushiki Kaisha, Tokyo, Japan

[21] Appl. No.: 966,046

[22] Filed: Dec. 4, 1978

[30] Foreign Application Priority Data

Dec. 9, 1977 [JP] Japan ..... 52/148321

[51] Int. Cl.[3] ..... H01J 29/46; H01J 29/56

[52] U.S. Cl. ..... 315/14

[58] Field of Search ..... 315/14, 15, 382, 16

[56] References Cited

U.S. PATENT DOCUMENTS 3,852,637 12/1974 Yamazaki et al. ..... 315/16

3,995,194 11/1976 Blacker, Jr. et al. ..... 315/16

OTHER PUBLICATIONS

Spangenbergs, *Vacuum Tubes,* McGraw Hill, pp. 355–359.

Kemperer, *Electron Optics,* University Press, pp. 18–21.

*Primary Examiner*—Theodore M. Blum

*Attorney, Agent, or Firm*—Wenderoth, Lind & Ponack

[57] ABSTRACT

The disclosed electron gun comprises a main focussing electron lens formed of three aligned grids and an acceleration electron lens preceding the main electron lens and formed of the first two of those grids or of the first one of those grids and another grid preceding it. The acceleration lens is disposed at such a position that the principal plane of the object space of the lens is located adjacent to the virtual object point of the outermost electron ray of the electron beam incident upon the lens. The lengths of the grids forming both lens are described.

4 Claims, 23 Drawing Figures

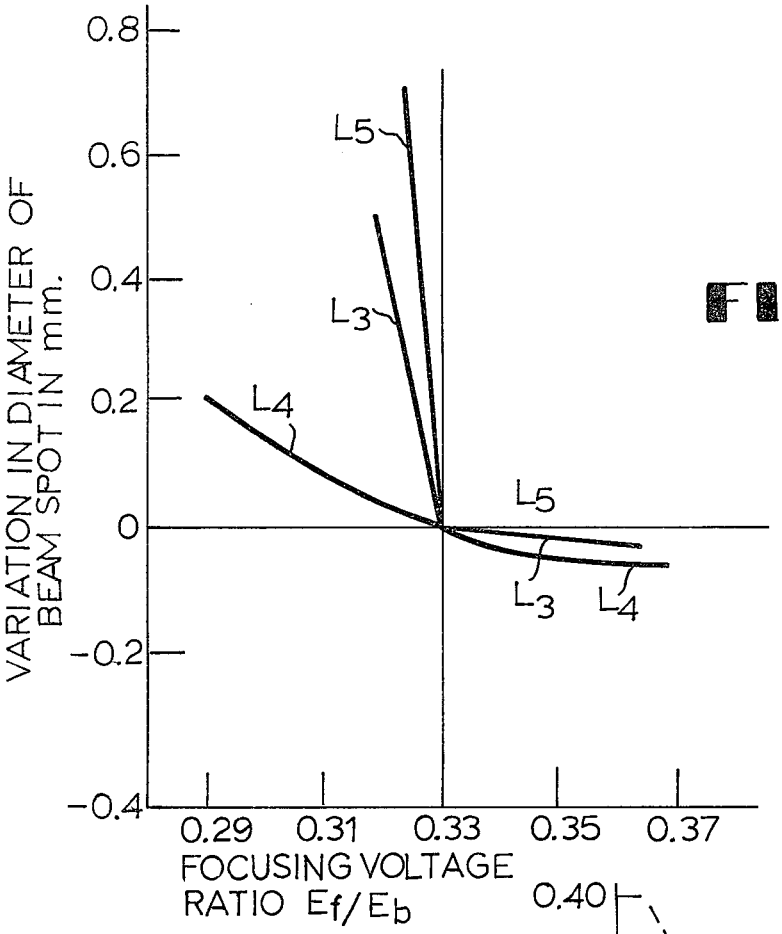
FIG.13
FIG.12c
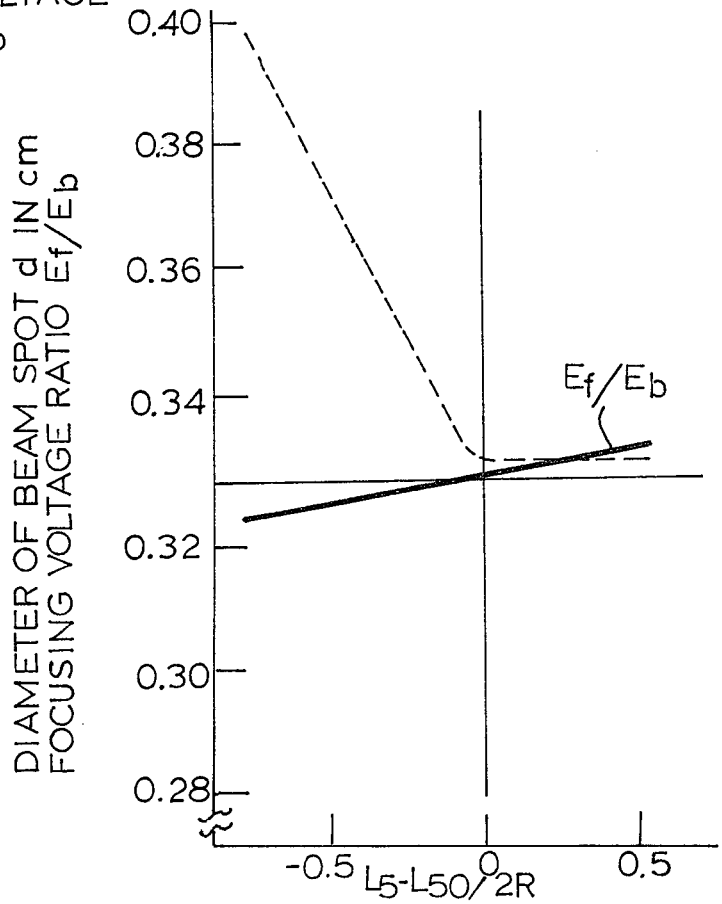

ELECTRON GUN

BACKGROUND OF THE INVENTION

This invention relates to improvements in an electron lens for focussing an electron beam emitted from the electron gun used in image forming tubes.

Conventional electron lenses for the electron gun widely used with image forming tubes have been generally divided into the bipotential and unipotential types. At present, the bipotential type of electron guns has been widely adopted particularly in color cathode ray tubes and comprises a cathode, and a first, a second, a third and a fourth grid disposed in the named order on the central axis thereof while the electron lens thereof is disposed on the central axis and is formed of the fourth grid having a high voltage applied thereto and the third grid having applied thereto a moderate voltage equal to about 20% of the high voltage.

In the bipotential type of conventional electron guns as described above, the focussed electron beam spot has been large in diameter in the high current range. For the bipotential type having a triad of electron guns arranged in the delta or the in-line configuration within color image forming tubes, the inside diameter of the neck portion of the tube might limit the aperture of an associated electron lens and increase the spherical aberration thereof because the associated electron gun is disposed in the neck portion. This has resulted in problems because the focussed electron beam spot can not have a sufficiently small spot diameter in the high current range and therefore the resolution is severely decreased. For example, white characters displayed on the phosphor screen of color image forming tubes might become obscure or thick.

On the other hand, the unipotential type of conventional electron guns has been presently employed in one part of color image forming tubes and includes an electron lens formed of a pair of spaced end grids and an intermediate grid interposed therebetween, all the grids being disposed coaxially with one another on the central axis. The end grids have been equal in potential to each other and supplied with equal voltages while the intermediate grid has been supplied with a low voltage kept substantially at the ground potential whereby the resulting potential distribution is saddle-shaped along the central axis of the electron gun.

The unipotential type of conventional electron guns as described above has an increased spherical aberration of the electron lens involved and the focussed beam spot in a high current range includes a small bright core lying at the center thereof and a large dark halo located around the core. This has resulted in a disadvantage because the sharpness becomes bad but the resolution is good while the focussed beam forms a large spot in the low current range and the resolution is deteriorated in that range. In addition, a disadvantage occurs because the dielectric strength characteristics within image forming tubes are adversely affected by such an array of three grids because a high voltage is present on either side of the intermediate grid held at a low potential.

From the foregoing it will be readily understood that both the bipotential type and the unipotential type of conventional electron guns have characteristic features some of which are advantageous and some of which are disadvantageous. Also these conventional electron guns have been unable to increase the resolution over the entire region extending from the low to the high current range and particularly for the latest color image forming tubes which are increasingly operated with high currents at high voltages approximately 30 kilovolts in order to increase the luminescence of the phosphor screen or picture surface thereof.

Accordingly it is an object of the present invention to provide an electron gun including an improved electron lens for increasing the resolution of formed pictures.

It is another object of the present invention to provide an electron gun including an improved electron lens lower in spherical aberration.

SUMMARY OF THE INVENTION

The present invention provides an electron gun comprising a main electron lens and an electron lens preceding the main electron lens and including at least an acceleration type electron lens portion having the principal plane of the object space thereof located adjacent to the position of the virtual object point of the outermost electron ray of the electron beam incident upon the acceleration type electron lens portion.

In a preferred embodiment of the present invention, the main electron lens may be formed of a pair of spaced end grids and an intermediate grid interposed therbetween, all the grids being equal or nearly equal in diameter to one another and disposed coaxially with respect to one another, a voltage $E_f$ being applied to the intermediate grid which has an axial length of $L_f$, a voltage $E_b$ being applied to each of the end grids and the inside radius R of the grids fulfills the relationship $$1.5 \lesssim \frac{L_f}{2R} \lesssim \frac{1}{A^2}\left(\frac{E_f}{E_b}\right)^2 + 0.85$$

where A has a value of 0.185.

In order to decrease spherical aberration, the acceleration type electron lens portion may include a third grid and a fourth grid disposed coaxially with respect to each other, and the main electron lens may include a fourth grid, a fifth grid and a sixth grid disposed coaxially with respect to one another, the third and fifth grids being electrically coupled to each other and having applied thereto a focussing voltage $E_f$, and the fourth and sixth grids being electrically coupled to each other and having applied thereto a high voltage $E_b$, while the third grid has an axial length $L_3$ determined so that the principal plane of the object space of the acceleration type electron lens portion is located adjacent to the position of the virtual object point of the outermost electron ray of an electron beam emitted from the cathode electrode of the electron gun, the fifth grid having an axial length $L_5$ fulfilling the relationship $$1.5 \lesssim \frac{L_5}{2R} \lesssim \frac{1}{A^2}\left(\frac{E_f}{E_b}\right)^2 + 0.85$$

where 2R designates the inside diameter of the main electron lens and A has a value of 0.185, and the fourth grid having an axial length $L_4$ dependent upon the focussing voltage ratio $E_f/E_p$ and fulfilling the relationship $$L_4 \lesssim L_3 < L_5$$

at least when $E_f/E_b \lesssim 0.33$ holds.

BRIEF DESCRIPTION OF THE DRAWINGS

The present invention will become more readily apparent from the following detailed description taken in conjunction with the accompanying drawings in which.

Figure 5:
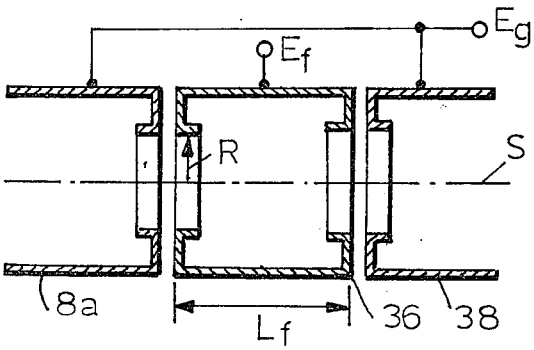
FIG. 5 is a longitudinal sectional view of one form of the main electron lens of the present invention useful in explaining the operation of the present invention.

FIGS. *7a* through *7g* are curves describing the relationship between the refractive power of the arrangement shown in FIG. 5 and an electron orbit running therein.

Figure 4:
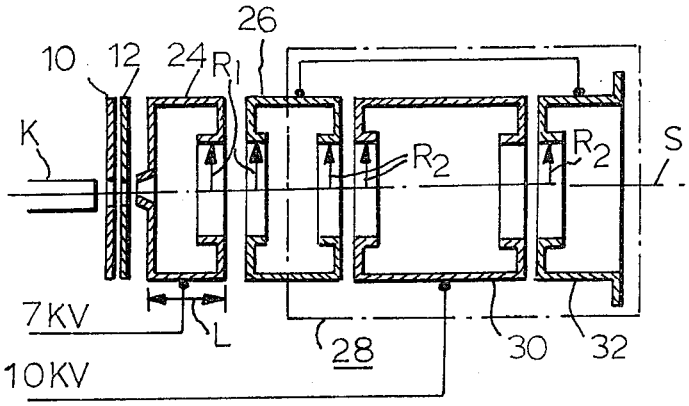
FIG. 4 is view similar to FIG. 3 but illustrating the details of the main electron gun schematically shown in FIG. 3.
Figure 8:
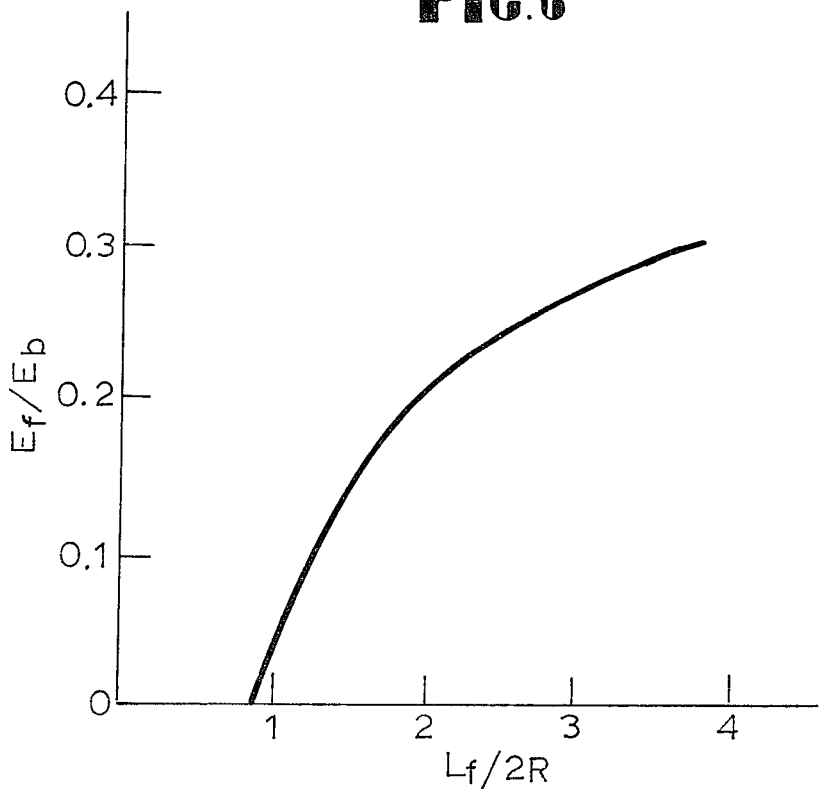
Figure 9:
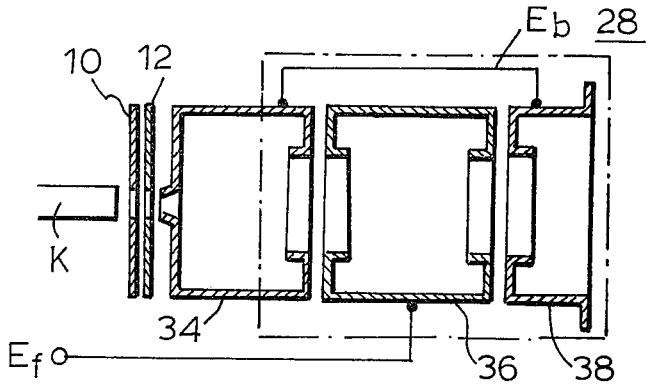
Figure 10:
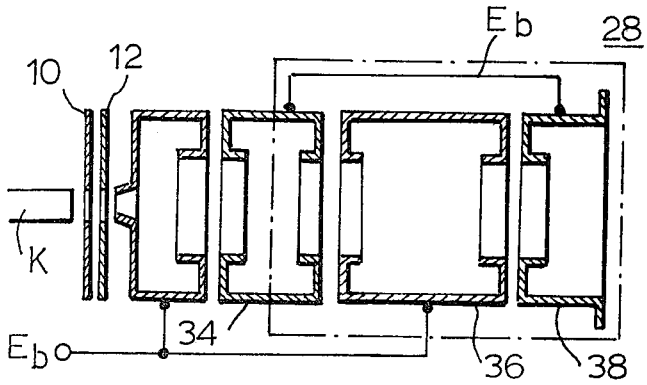
Figure 11:
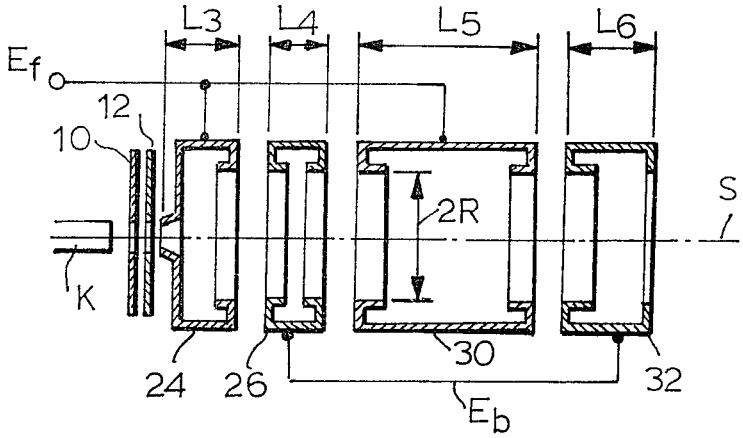
Figure 12A:
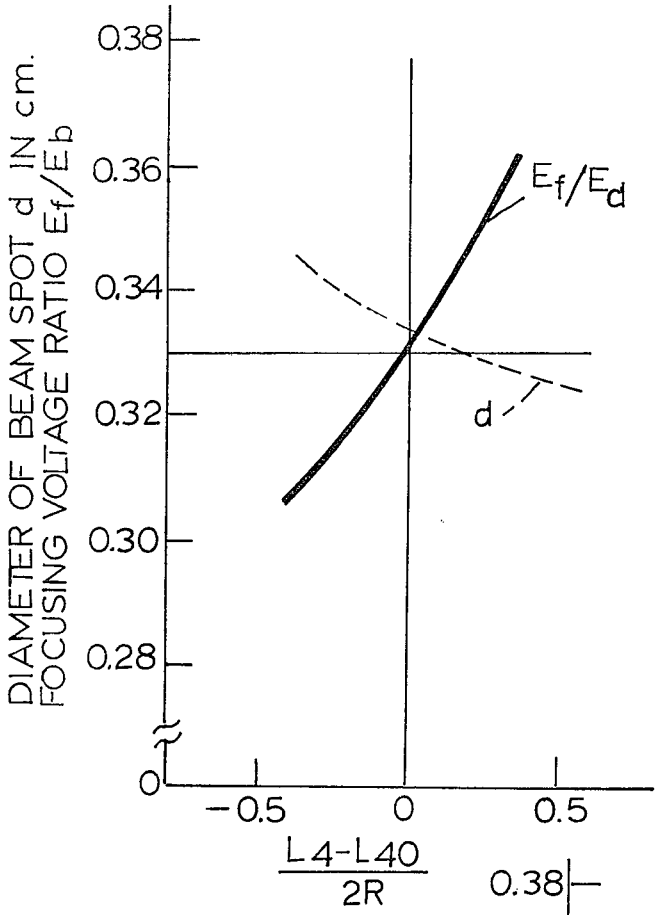
Figure 12B:
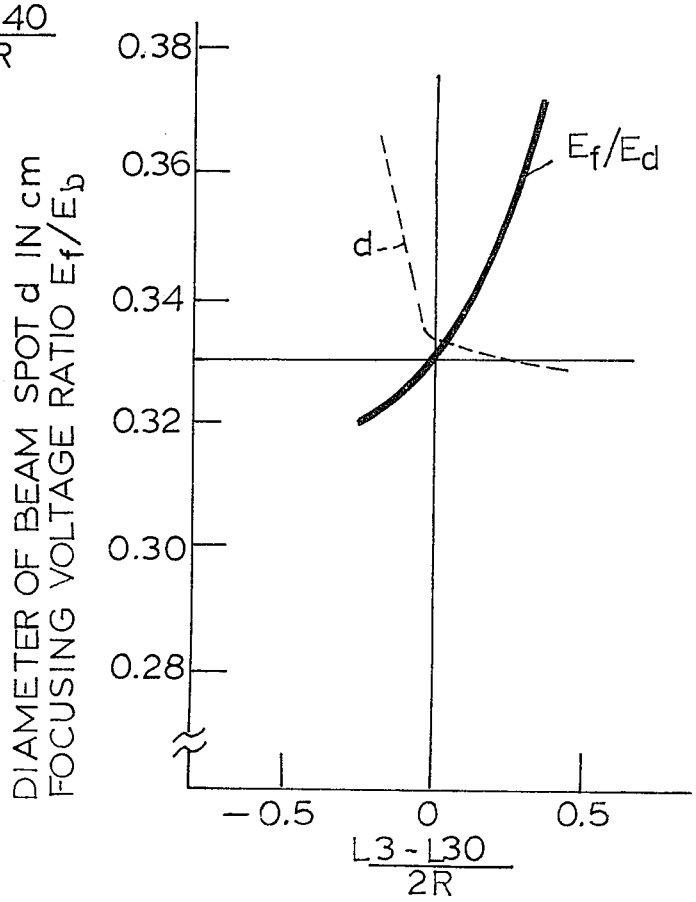

FIG. 8 is a graph illustrating the relationship between the length of the intermediate electrode shown in FIG. 5 and the focussing voltage ratio;

FIG. 9 is view similar to FIG. 4 but illustrating an electron gun including the arrangement shown in FIG. 5;

FIG. 10 is a view similar to FIG. 4 but illustrating another electron gun including the arrangement shown in FIG. 5;

FIG. 11 is a schematic longitudinal sectional view of a modification of the present invention;

FIGS. 12*a* through 12*c* are graphs illustrating the characteristics of the arrangement shown in FIG. 11;

FIG. 13 is a graph illustrating the relationship between the diameter of the focussed beam spot and the focussing voltage ratio resulting from data shown in FIGS. 12*a* through 12*c;*

Figure 14:
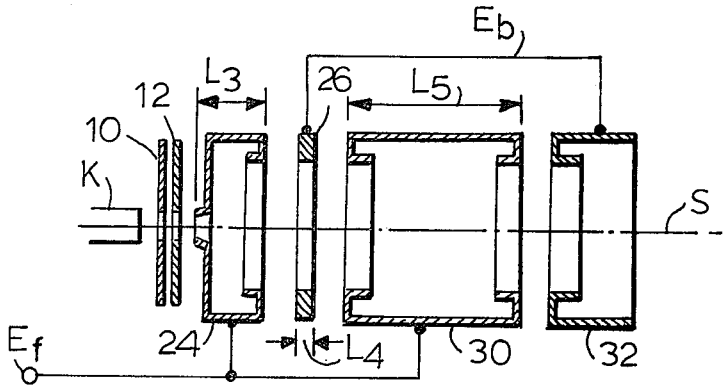
Figure 15:
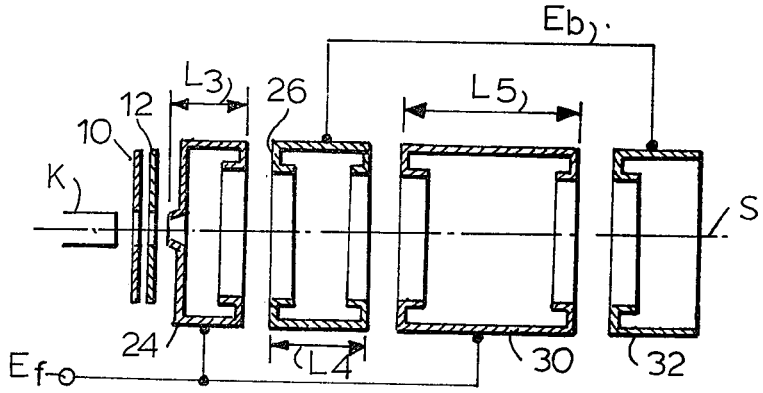

FIG. 14 is a view similar to FIG. 11 but illustrating the arrangement of FIG. 11 suitable for a focussing voltage ratio not less than a predetermined value; and FIG. 15 is a view similar to FIG. 11 but illustrating the arrangement of FIG. 11 suitable for a focussing voltage ratio less than the predetermined value.

Throughout the Figures, like reference numerals and characters designate the identical or corresponding components.

DESCRIPTION OF THE PREFERRED EMBODIMENTS

Figure 1:
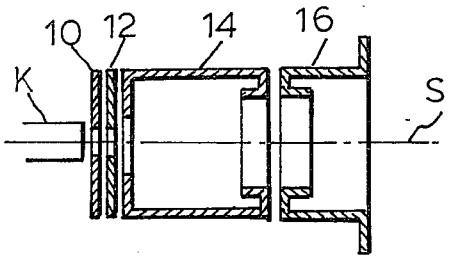
(PRIOR ART) FIG. 1
FIG. 1 is a schematic longitudinal sectional view of a conventional bipotential electron gun.

Referring now to FIG. 1 of the drawings, there is illustrated a conventional bipotential electron gun used in an image forming tube. The arrangement illustrated comprises a cathode electrode K and a first grid 10, a second grid 12, a third grid 14, and a fourth grid 16 respectively disposed at predetermined intervals in the named order on the central axis S of the electron gun. The fourth grid 16 has a high voltage applied thereto and forms an electron lens with the third grid 14 which has applied thereto a moderate voltage equal to about 20% of the high voltage. The arrangement of FIG. 1 has had the disadvantages described above.

Figure 2:
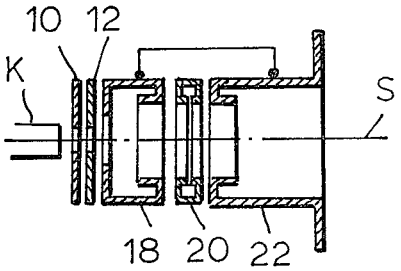
(PRIOR ART) FIG. 2
FIG. 2 is a view similar to FIG. 1 but illustrating a conventional unipotential electron gun.

FIG. 2 shows a conventional unipotential electron gun including three grids or a third grid 18, a fourth grid 20 and a fifth grid 22 substituted for the grids 14 and 16 shown in FIG. 1. The third grid 18 and the fifth grid 22 are respectively located nearest to and farthest from the cathode electrode K and have equal voltages applied thereto. That is, both grids are equal in potential to each other while the fourth grid 20 disposed between the third grid 18 and fifth grid 22 has applied thereto a low voltage approximating the ground potential whereby a saddle-shaped potential distribution is formed along the central axis S of the electron gun. The arrangement of FIG. 2 has had the disadvantages described above.

Figure 3:
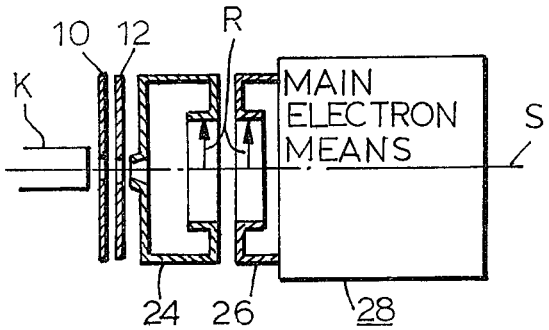
FIG. 3 is a schematic longitudinal sectional view of one embodiment according to the electron gun of the present invention.

Referring now to FIG. 3 there is illustrated one embodiment according to the electron gun of the present invention. The arrangement illustrated includes an acceleration type bipotential electron lens preceding the main electron lens, that is, between the electron source and the electron lens. More specifically, the arrangement comprises the cathode electrode K, and a first grid 10, a second grid 12, a third grid 24 and a fourth grid 26 respectively disposed at predetermined intervals in the named order on the central axis S of the electron gun. Disposed on that side of the fourth grid 26 remote from the cathode electrode K is the main electron lens schematically represented by a broken block generally designated by the reference numeral 28. The main electron lens 28 is coaxial with the central axis S and operative to finally focus the electron beam emitted from the cathode electrode K on a phosphor screen or a picture surface of an image forming tube (not shown). All the grids are shown in FIG. 3 as being equal in outside and inside diameters to one another.

The third grid 24 and the fourth grid 26 preceding the main electron lens 28 form an acceleration type bipotential electron lens with the fourth grid 26 also forming one part of the main electron lens 28. According to the present invention, this electron lens has the principal plane of the object space thereof located at the position of the virtual object point of the outermost electron ray of the electron beam emitted from the electron gun composed of the cathode electrode K and the first grid 10, the second grid 12 and the third grid 26. The term "outermost electron ray" means that portion passing through the outermost side of an electron beam incident upon the electron lens and the term "virtual object point" means the point at which the central axis of the electron gun intersects an extension of the path of the outermost electron ray running a direction opposite from the direction of travel of the electron beam. By positioning the acceleration type bipotential electron lens as described above, the following results occur:

(1) The outermost electron ray has the position of its virtual object point that remains substantially unchanged before and after its passage through the bipotential electron lens;

(2) The outermost electron ray has an angle of divergence capable of decreasing by $1/\sqrt{N}$ where N designates the ratio of the potential at the fourth grid 26 to that at the third grid 24; and (3) The outermost electron ray is not subjected to spherical aberration exhibited by the acceleration type bipotential electron lens.

In other words, after having passed through the acceleration type bipotential electron lens, the electron beam from the electron gun K-10-12-24 has the position of its virtual object point remaining substantially unchanged, and has its angle of divergence alone decreased, whereby it is very unlikely to be affected by the spherical aberration of the main electron lens due to this decrease in angle of divergence. Therefore, the electron beam can be focussed in an ideal state on an associated phosphor screen or picture surface. It has been found that the focussed beam has a spot diameter decreased by not less than 20% in the moderate and the high current range as compared with the prior art practice employing the main electron lens alone.

The main electron lens 28 is not particularly specified and may be of either the bipotential or unipotential type.

FIG. 4 shows the arrangement of FIG. 3 wherein the main electron lens is of the unipotential type. In FIG. 4 the main electron lens 28 is shown as including that end portion of the fourth grid 26 remote from the third grid 24, a fifth grid 30 and a sixth grid 32 disposed at predetermined intervals on the central axis S of the electron gun and also the third grid 24 and the fifth grid 30 are shown as having applied thereto a moderate voltage of 7 kilovolts and a high voltage of 30 kilovolts respectively with the fourth grid 26 electrically coupled to the sixth grid 32 through an internal lead. Further the third, fourth, fifth and sixth grids are equal in both outside diameter and inside radius to one another. As described above in conjunction with FIG. 3, the third grid 24 forms the acceleration type bipotential electron lens with the fourth grid 28 which also serves as an electrode for connecting the acceleration type bipotential electron lens to the main electron lens 28.

The third grid 24 has a length L (see FIG. 4) determined so that the outermost electron ray of the electron beam emitted from the cathode electrode K has the position of its virtual object point lying in the principal plane for the object space of the bipotential electron lens. Also, in order to minimize the ratio of the beam's diameter in the principal plane to the lens' aperture or the grid radius $R_1$ (see FIG. 4) of the lens, it is required to design and form the grid radius $R_1$ as large as possible. In the main electron lens 28 it is necessary to impart to the fifth grid 30 a length larger than two times the grid radius $R_2$ (see FIG. 4) thereof in order to decrease the resulting spherical abrration. Also it is desirable to increase the radius $R_2$ as far as circumstances permit.

As described above, the interconnected fourth grid 26 and sixth grid 32 have applied thereto the high voltage of 30 kilovolts while the fifth grid 30 has applied thereto a variable moderate voltage on the order of 10 kilovolts. Also a relatively low voltage of 7 kilovolts is applied to the third grid 24. Accordingly high voltages are present on both sides of the fifth grid 30 but this voltage distribution does not cause the deterioration of the interelectrode dielectric strength characteristic.

In the arrangement of FIG. 4, the grid radius $R_1$ of the acceleration type bipotential electron lens is different from the grid radius $R_2$ of the main electron lens but it is to be understood that, by making both radii equal to each other, electron guns can be easily assembled and manufactured.

It has been found that the arrangement of FIG. 4 can improve the focussing characteristics of electron beams over the entire current region with the result that sharp pictures can be viewed while the picture surface is bright.

The present invention is equally applicable to the unipotential type of the main electron lens 28.

Electron lenses generally have a spherical aberration $C_s$ expressed by $$C_s = \frac{1}{16\sqrt{\phi 0}} \int_{Z_O}^{Z_i} \frac{3}{\phi 2}\left(\frac{5\phi''^2}{4} + \frac{5\phi'^4}{24\phi^2} + \frac{14\phi^{13}rd'}{3\phi rd} - \frac{3\phi'^2 rd'^2}{2rd}\right) rd^4 dz \quad (1)$$

where $\phi_0$ designates the potential in the object space of electron lenses, $\phi$ the potential distribution along the longitudinal axis thereof, $\phi'$ the first order derivative of the potential $\phi$, $\phi''$ the second order derivative thereof, $Z_0$ the entrance point in the object space and $Z_i$ the exit point for the image space of electron lenses, and rd designates a reference orbit of electrons fulfilling the following initial conditions:

$$rd(Z_0)=0 \text{ and } rd'(Z_0)=1$$

Also rd' designates the first order derivative of the rd.

On the other hand, it has been seen from the observation of the size of beam spots focussed on the phosphor screen of image forming tubes that the beam spot includes a real spot portion that is very bright and weaker halo portion that appears around the real spot portion in the high beam current range.

It is now assumed that for a given magnitude of the beam current, the resulting beam spot has a minimum size without a halo portion developed. Under the assumed condition, the real spot portion coincides in size with the halo portion and has a size ds given by $$ds = \frac{1}{2} \cdot \frac{\left(\frac{b}{a} + 1\right)\left(\frac{C_s}{f^3}\right)(\theta_m a)^3}{1 + 0.75\left(\frac{C_s}{f^3}\right)(\theta_m a)^2} \quad (2)$$

where a designates the distance between the object point and the principal plane for the object space of the electron lens, b the distance between the principal plane for the image space of the electron lens and the picture surface of the image forming tube involved, $\theta_m$ the angle of divergence of the outermost incident electron ray for the predetermined magnitude of beam current and f designates the focal length of the electron lens.

From the expression (2) it is seen that, as long as the spherical aberration $C_s$ is not zero, even a point source electron beam can not yield a zero diameter focussed beam spot and that the smaller the value of $C_s/f^3$ the smaller the resulting spot size will be.

FIG. 5 shows one form of the present invention applied to a unipotential type of main electron lens 28 (see FIG. 3). The arrangement illustrated comprises one end grid 34, an intermodiate grid 36 and another end grid 38 disposed at predetermined intervals on the central axis S of an associated electron gun (not shown) with all the grids equal in diameter to one another. A common potential $E_b$ is applied to both end grids 34 and 38 while a focussing potential $E_f$ is applied to the intermediate grid 36. Heretofore, the term "unipotential type electron lens" generally refers to what includes an intermediate grid having a zero or a low potential applied thereto. However, the present invention provides a unipotential type main electron lens having the optimum configuration of grids involved without the potential $E_f$ particularly specified.

Figure 6:
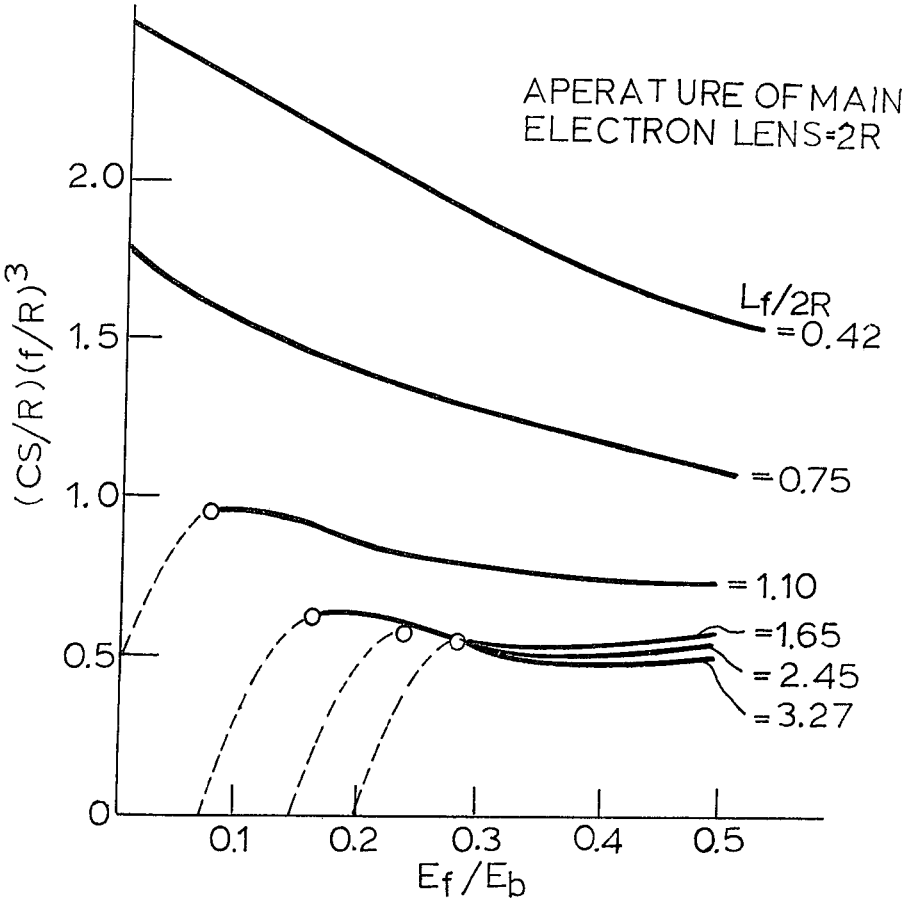
FIG. 6 is a graph illustrating the spherical aberration and the lens parameters of the arrangement as shown in FIG. 5 plotted against the focussing voltage ratio.

FIG. 6 shows how the quotient of the spherical aberration $C_s$ divided by the third power of the focal length f or $C_s/f^3$ normalized with respect to the grid radius R of the lens (see FIG. 5) changes with the focussing voltage ratio $E_f/F_p$ while the parameter is expressed by the length $L_f$ (see FIG. 5) of the intermediate grid normalized with respect to the grid diameter 2R of the lens.

Figure 7A:
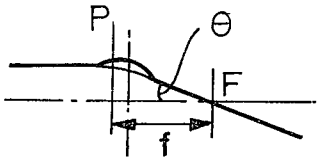
Figure 7B:
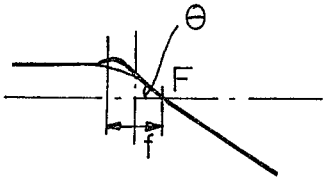
Figure 7C:
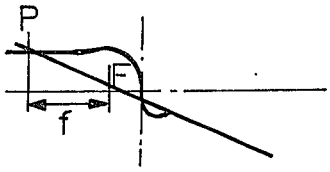
Figure 7D:
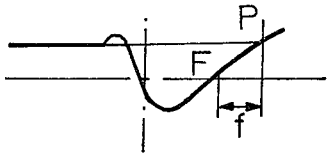
Figure 7E:
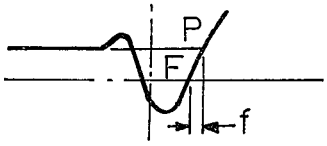
Figure 7F:
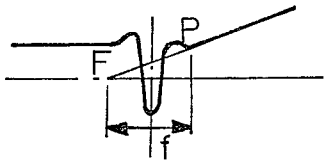
Figure 7G:
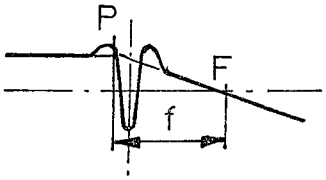

In regions designated by solid lines in FIG. 6, the electron lens has such a refractive power that the associated electron orbit runs as shown in FIG. 7*a* or 7*b*. The electron orbit shown in FIG. 7*a* changes to that illustrated in FIG. 7*b* as the electron lens increases in power.

However, in regions designated by dotted lines in FIG. 6, the electron lens has such a high refractive power that the expression (1) does not yield the correct spherical aberration. Under these circumstances the electron orbit runs substantially as shown in any of the FIGS. 7*c* through 7*g*. As the refractive power of the electron lens increases the associated electron orbit succesively changes in the order of FIGS. 7*c*, 7*d*, 7*e*, 7*f* and 7*g*. For the electron orbit such as shown in any of those Figures, the electron lens has an actual value of spherical aberration which is very large even though the spherical aberration would have been calculated as a small value. This results in a large size of the resulting beam spot. Accordingly, it is not advisable to operate the electron lens in such a region.

From FIG. 6 it is seen that (1) the longer the intermediate grid 36 the smaller the sperical aberration of the electron lens will be, however the latter has a lower limit because of its saturation at about $L_f/2R \geqq 1.5$; and that (2) an increase in length of the intermediate grid permits a decrease in spherical aberration of the electron lens together with an increase in the focussing potential $E_f$ available.

In FIG. 8 wherein the focussing voltage ratio $E_f/E_p$ is plotted in abscissa against the length of the intermediate grid normalized with respect to the grid diameter of the electron lens or $L_f/2R$ in ordiate, there is illustrated the range in which the length $L_f$ of the intermediate grid 36 and the voltage $E_f$ applied to the latter may be selected. The curve shown in FIG. 8 may be approximately expressed by $$\frac{L_f}{2R} \lesssim \frac{1}{A^2}\left(\frac{E_f}{E_b}\right)^2 + 0.85 \text{ for } A = 0.185$$

The range in which the length $L_f$ and the voltage $E_f$ may be selected is located on and above the curve.

From the foregoing it will be readily understood that the length $L_f$ of the intermediate grid 36 preferably satisfies the following expression:

$$1.5 \lesssim \frac{Lf}{2R} \lesssim \frac{1}{A^2}\left(\frac{E_f}{E_b}\right)^2 + 0.85 \text{ for } A = 0.185$$

FIGS. 9 and 10 show respective electron guns including the arrangement of FIG. 5. In FIG. 9, the arrangement of FIG. 3 is modified so that the main electron lens formed of the three electrodes 34, 36 and 38 as shown in FIG. 5 is disposed in a spaced relationship on that side of the second grid 12 remote from the cathode electrode K with the electrode 34 made similar in shape to the third grid 24.

The arrangement illustrated in FIG. 10 is similar to that shown in FIG. 4 but the focussing voltage $E_f$ is applied to both the third grid 24 and the intermediate electrode 36 and the electrode 34 is electrically coupled to the electrode 38 through an internal lead and supplied with the high voltage $E_b$.

From the foregoing it is seen that it is possible to construct an electron lens having a small spherical aberration and that the electron gun can be improved in performance of focussing the electron beam.

The arrangement illustrated in FIG. 11 is substantially similar to that shown in FIG. 4 except that the focussing voltage $E_f$ is applied to the third grid 24 and the fifth grid 30 and that the grids have respective lengths particularly specified in order to further improve the resolution and sharpness of formed pictures. The third grid 24 has a length $L_3$ determined so that the principal plane of the object space of the electron lens formed of the third grid 24 and the fourth grid 26 is located adjacent to the position of the virtual object point of the outermost electron ray of the electron bram emitted from the electron gun composed of the cathode electrode K, and the first grid 10, the second grid 12 and the third grid 24. This length $L_3$ is a function of the ratio of voltage between the third grid 24 and the fourth grid 26, and the length $L_3$ normalized with respect to the inside diameter 2R of the electron lens normally ranges from 0.6 to 1.3. That is, $L_3/2R = 0.6 \sim 1.3$ holds.

The fifth grid 30 has a length $L_5$ satisfying $$1.5 \lesssim \frac{L_5}{2R} \lesssim \frac{1}{A^2}\left(\frac{E_f}{E_b}\right)^2 + 0.85$$

where A has a value of 0.185. Therefore $L_3 < L_5$ holds. When the length $L_5$ of the fifth grid 30 is determined as described above, it is possible to decrease the spherical aberration of a unipotential type main electron lens formed of the fourth grid 26, the fifth grid 30 and the sixth grid 32 respectively and still make the focussing voltage $E_f$ as low as possible.

Alternatively, the fourth, fifth and sixth grids may form a composite electron lens including an acceleration and a deceleration type bipotential electron lens portion.

The sixth grid 32 has a length $L_6$ capable of being relatively freely determined. However, in order to prevent the righthand side as viewed in FIG. 11 of the sixth grid 32 or the side of a phosphor screen of the associated image forming tube (not shown) from affecting the electric field established in the region of the main electron lens, the length $L_6$ of the sixth grid is generally determined so that $L_6/2R \geqq 1$ holds.

Finally, the fourth grid 26 has a length $L_4$ determined so that the diameter of the beam spot focussed on the phosphor screen (not shown) is minimized with the required focussing voltage $E_f$. As in the arrangements described above, the fourth grid 26 forms an electron lens with the third grid 14 and also serves as an electrode for connecting that electron lens to the main electron lens formed of the fourth grid 24, the fifth grid 30 and the sixth grid 32 respectively.

In image forming tubes including the arrangement of FIG. 11, the focussing voltage ratio $E_f/E_b$ and the diameter of the beam spot focussed on the phosphor screen thereof were measured by changing the length of one of the third, fourth and fifth grids while the lengths of the other two grids remained unchanged. The results of the measurements are indicated in FIGS. 12*a*, 12*b* and 13*c* where the ordinate represents both the focussing voltage ratio $E_f/E_b$ and the diameter in centimeters of the focussed beam spot and the abscissa represents the difference between the variable and the constant length of the associated grid normalized with respect to the inside diameter of the main electron lens. The solid curve depicts the focussing voltage ratio and the dotted curve depicts the diameter of the focussed beam spot. In FIG. 12*a*, the length $L_4$ of the fourth grid 26 was increased and decreased from a constant length $L_{40}$ thereof, while the lengths of the third grid 24 and the fifth grid 30 remained unchanged. In FIG. 12*b* the length $L_3$ of the third grid 24 was increased and decreased from a constant length $L_{30}$ thereof while the lengths of the fourth grid 26 and the fifth grid 30 remained unchanged. Also in FIG. 12*c* the length $L_5$ of the fifth grid 30 was similarly changed from a constant length $L_{50}$ thereof while the third grid 24 and the fourth grid 26 remained unchanged.

Data shown in FIGS. 12*a*, 12*b* and 12*c* can be unified into the relationship between the focussing voltage ratio $E_f/E_b$ and the variation in diameter of the focussed beam spot due to a change in the length of each of the third, fourth and fifth grids as shown in FIG. 13 wherein the abscissa represents the focussing voltage ratio $E_f/E_b$ and ordinate represents the variation in diameter in millimeters of the focussed beam spot.

From FIG. 13 it is seen that (1) it is possible to lower the focussing voltage by decreasing the length of the grids but a decrease in the length $L_4$ of the fourth grid 26 is the most effective for minimizing an increase the diameter of the focussed beam spot, and next the third grid 24 and then the fifth grid 30 becomes effective, and that (2) it is possible to raise the focussing voltage by increasing the length of the grids or electrodes but an increase in length of either the third or fourth grid 24 or 26 is most effective for doing so because the fifth grid 30 causes only a small change in the focussing voltage.

This increase in the length of the grids 24 or 26 affects the diameter of the focussed beam spot less.

Consequently, the lengths of the respective grids are selected to satisfy $L_4 \lesssim L_3 < L_5$ for the relative focussing voltage $E_f/E_b \lesssim 0.33$ and generally $L_3 \lesssim L_4 < L_5$ for a relative focussing voltage $E_f/E_b > 0.33$. As shown in FIG. 13, $E_f/E_b = 0.33$ corresponds to a null in the variation in diameter of the focussed beam spot.

The arrangement of FIG. 11 may be modified to become that shown in FIG. 14 for the $E_f/E_b \lesssim 0.33$ and to become that shown in FIG. 15 for the $E_f/E_b > 0.33$.

From the foregoing it is seen that the present invention can provide an electron gun including an focussing electron lens having a small aberration. Therefore the resulting picture is high in both resolution and sharpness.

While the present invention has been illustrated and described in conjunction with a few preferred embodiments thereof it is to be understood that numerous changes and modifications may be resorted to without departing from the spirit and scope of the present invention. For example, the arrangement illustrated in FIG. 11 has the third and fifth grids electrically coupled to each other, but a moderate voltage with a fixed magnitude may be applied to the third grid. The present invention has been described in conjunction with the electrodes or grids having the same inside diameter but the present invention is equally applicable to grids or electrodes more or less different in inside diameter from one another.

We claim:

1. An electron gun comprising a main electron lens and an electron lens preceding said main electron lens and said preceding electron lens including at least an acceleration type electron lens portion, said acceleration type electron lens portion having the principal plane of the object space thereof located adjacent to the position of the virtual object point of the outermost electron ray of the electron beam incident upon said acceleration type electron lens portion;

wherein said main electron lens is formed of a pair of spaced end grids and an intermediate grid interposed therebetween, all of said grids being equal or nearly equal in diameter to one another and disposed coaxially with respect to one another, said end grids having a potential different from said equal potentials applied thereto, and wherein said applied different potential and the length of said intermediate grid determined so that the parameters of said main electron lens fulfills $$\frac{C_s/R}{(f/R)^3} \approx 0.4 \sim 0.7$$

where $C_s$ designates the spherical aberration of the main electron lens, R the grid radius thereof and f designates the focal distance thereof.

2. An electron gun as claimed in claim 1, wherein voltage $E_f$ applied to said intermediate grid, the axial length $L_f$ thereof, the grid radius R of the main electron lens and the voltages $E_b$ applied to each of said end electrodes fulfill the relationship $$1.5 \lesssim \frac{L_f}{2R} \lesssim \frac{1}{A^2}\left(\frac{E_f}{E_b}\right)^2 + 0.85$$

where A has a value of 0.185.

3. An electron gun comprising a main electron lens and an electron lens preceding said main electron lens and said preceding electron lens including at least an acceleration type electron lens portion, said acceleration type electron lens portion having the principal plane of the object space thereof located adjacent to the position of the virtual object point of the outermost electron ray of the electron beam incident upon said acceleration type electron lens portion; and further comprising a cathode electrode for emitting an electron beam, and wherein said acceleration type electron lens portion includes a third grid and a fourth grid disposed coaxially with respect to each other, said main electron lens includes the fourth grid, a fifth grid and a sixth grid disposed coaxially with respect to one another, said third and fifth grids are electrically coupled to each other and have a focussing voltage $E_f$ applied thereto, and said fourth and sixth grids are electrically coupled to each other and have a high voltage $E_b$ applied thereto, and wherein said third grid has an axial length $L_3$ determined so that the principal plane of the object space of said acceleration type electron lens portion is located adjacent to the position of the virtual object point of the outermost electron ray of said electron beam emitted from said cathode electrode for the electron gun, and said fifth grid has an axial length $L_5$ fulfilling the relationship $$1.5 \lesssim \frac{L_5}{2R} \lesssim \frac{1}{A^2}\left(\frac{E_f}{E_b}\right)^2 + 0.85$$

where 2R designates the inside grid diameter of the main electron lens and A has a value of 0.185, and said fourth grid has an axial length $L_4$ dependent upon the focussing voltage ratio $E_f/E_b$ and fulfilling the relationship $L_4 \lesssim L_3 < L_5$ at least when $E_f/E_b \lesssim 0.33$ holds.

4. An electron gun comprising a main electron lens and an electron lens preceding said main electron lens and said preceding electron lens including at least an acceleration type electron lens portion, said acceleration type electron lens portion having the principal plane of the object space thereof located adjacent to the position of the virtual object point of the outermost electron ray of the electron beam incident upon said acceleration type electron lens portion; and further comprising a cathode electrode for emitting an electron beam, and wherein said acceleration type electron lens portion includes a third grid and a fourth grid disposed coaxially with respect to each other, said main electron lens includes a fourth grid, a fifth grid and a sixth grid disposed coaxially with respect to one another, said third grid has a focussing voltage $E_f$ applied thereto, and wherein said third grid has an axial length $L_3$ determined so that the principal plane of the object space of said acceleration type electron lens portion is located adjacent to the position of the virtual object point of the outermost electron ray of said electron beam emitted from said cathode electrode for the electron gun, said fifth grid has an axial length $L_5$ fulfilling the relationship $$1.5 \lesssim \frac{L_5}{2R} \lesssim \frac{1}{A^2}\left(\frac{E_f}{E_b}\right)^2 + 0.85$$

where 2R designates the inside grid diameter of the main electron lens and A has a value of 0.185, and said fourth grid has an axial length $L_4$ dependent upon the focussing voltage ratio $E_f/E_p$ and fulfilling the relationship $L_4 \lesssim L_3 < L_5$ at least when $E_f/E_b \lesssim 0.33$ holds.

* * * * *